US005400652A

United States Patent [19]

Haar

[11] Patent Number: 5,400,652

[45] Date of Patent: Mar. 28, 1995

[54] PLATE POSITIONING SYSTEM FOR PRESSES

[75] Inventor: Thomas Haar, Halstenbek, Germany

[73] Assignee: Alfons Haar Maschinenbau GmbH & Co., Germany

[21] Appl. No.: 173,272

[22] Filed: Dec. 23, 1993

Related U.S. Application Data

[63] Continuation of Ser. No. 965,977, Oct. 26, 1992, abandoned.

[30] Foreign Application Priority Data

Oct. 31, 1991 [DE] Germany ..... 41 35 901.1

[51] Int. Cl.[6] ..... B21D 43/11; B65G 25/04

[52] U.S. Cl. ..... 83/206; 83/277; 83/280; 198/468.2; 198/468.9; 271/84; 271/268; 414/225; 414/751

[58] Field of Search ..... 83/35, 36, 50, 206, 83/220, 250, 256, 277, 279, 280, 281, 251, 228, 409; 269/13, 14; 198/468.01, 468.2, 468.9; 271/84, 266, 268; 414/225, 751

[56] References Cited

U.S. PATENT DOCUMENTS

| | | | |
|---|---|---|---|
| 1,650,748 | 11/1927 | Thomas | 83/76.4 |
| 2,966,086 | 12/1960 | Sjostrom | 83/206 X |
| 3,424,044 | 1/1969 | Thumim et al. | 83/277 X |
| 3,449,991 | 6/1969 | Daniels | 83/277 X |
| 3,466,958 | 9/1969 | Munson | 83/280 X |
| 4,015,702 | 4/1977 | Bergling | 83/206 X |
| 4,297,927 | 11/1981 | Kuroda | 83/36 |
| 4,305,331 | 12/1981 | Colapinto | 198/468.2 X |
| 4,372,538 | 2/1983 | Balfanz | 414/751 X |
| 4,382,395 | 5/1983 | Haar | 83/76.8 |
| 4,524,656 | 6/1985 | Del Fabro et al. | 83/277 X |
| 4,621,552 | 11/1986 | Lopez | 83/277 X |
| 4,691,817 | 9/1987 | Haar | 271/268 X |
| 5,007,317 | 4/1991 | Jenkner | 83/256 |
| 5,311,799 | 5/1994 | Mohr | 83/280 X |

FOREIGN PATENT DOCUMENTS

| | | | |
|---|---|---|---|
| 617482 | 8/1935 | Germany | 83/220 |
| 1111133 | 7/1961 | Germany . | |
| 8318201 | 11/1983 | Germany . | |
| 3437642 | 4/1986 | Germany . | |
| 490291 | 8/1938 | United Kingdom | 83/281 |

*Primary Examiner*—Richard K. Seidel
*Assistant Examiner*—Clark F. Dexter
*Attorney, Agent, or Firm*—Faegre & Benson

[57] ABSTRACT

A plate positioning system for presses, comprising a feeding slide guided along a first axis which is moved to and from the cutting tool of the press, at least a pair of releasable gripping mechanism (preferably gripping pliers), which are guided by the slide along a second axis to be adjustable relative to the first axis, a serving slide which is adjustable along the first axis, which serving slide includes releasable gripping mechanism (preferably gripping pliers) to advance a plate into a transfer position to be taken by the first gripping mechanism, wherein the gripping mechanism engage opposite sides of a plate at a trailing edge thereof, wherein the transfer position corresponds to the plate position for the first cut and wherein the transfer of the plate to the first gripping mechanism is performed during the first cut, the serving slide bringing the plate into the transfer position only when the gripping mechanism have reached their receiving position along both axes.

4 Claims, 2 Drawing Sheets

PLATE POSITIONING SYSTEM FOR PRESSES

This application is a continuation of application Ser. No. 07/965,977, filed Oct. 26, 1992, now abandoned.

BACKGROUND OF THE INVENTION

The present invention relates to a plate positioning system for presses.

Plate positioning systems of this type are used to feed plates, for example aluminum sheet metal, in a predetermined position toward a press which cuts a certain number of blanks out of the plate. The plate is engaged by gripping means and moved by a feeding slide situated below the cutting tools. The feeding of the plate takes place along two orthogonal axes, since the cutting is performed in an offset spacing to save material.

DESCRIPTION OF THE PRIOR ART

DE-GM 83 18 201 discloses a plate positioning system comprising a feeding slide including a pair of gripping pliers which engage the trailing edge of the plate to stepwise feed the plate to the tool machine. The advance motion is coupled to the operation of the tool machine, for example a press, so that the advance is performed at a time at which the tool performs a return stroke. This means that the tool is outside the working plane at the time of the advance. After termination of a duty cycle for the plate, the feeding slide is returned into a starting position in which the next following plate is engaged. This following plate is advanced by a loading slide from a positioning station into the proper loading position in which the plate directly lies in front of the tool. Herewith the loading slide moves below the feeding means to convey the sheet metal plate into the loading or transfer position. Normally the drive means for the serving slide is designed such that the serving slide always presents the plate in the same position independently of the magnitude of the plate and the cutting pattern.

Between the last advancing step of the preceding plate and the transfer of a succeeding plate into the feeding device, a certain time necessarily elapses which is substantially longer than the cycle time of the press. In the plate positioning system according to the prior art, the gripping pliers must be first removed from the previous plate and then be brought into a position beyond the new plate, where they are subsequently brought into engagement with the trailing edge of the plate by being moved in opposite directions. The gripping pliers are thus subjected to two different adjusting movements, each one requiring an accelerating and a decelerating operation. For the fastest-operating of the known systems, this nonproductive transfer time is about 1.8 sec. This corresponds to about six idle strokes of a press performing 200 strokes per minute.

DE-OS 34 37 642 discloses a plate positioning system in which non-productive transfer times do not occur. However, this system requires a pair of separate feeding means each including gripping pliers operated in an alternating fashion to engage opposite side of the plate. Such a system is relatively complicated.

For systems operating with serving slides, it is possible to shut off the press to avoid idle strokes until the transfer of a new plate by the gripping means of the feeding slide has been completed. However, disengaging the press results in some substantial drawbacks: (a) there is substantial wear; (b) furthermore, the press must slowly run up to the operative speed after engaging the clutch, which could result in problems such as the dismissal of blanks.

SUMMARY OF THE INVENTION

It is the object of the present invention to provide a plate positioning system for presses which substantially reduces the transfer time for plates while the press runs continuously. This object is accomplished by the features of this invention described as follows.

A plate positioning system for presses, comprises a feeding slide which is guided by a guide means of a slide along the first axis to be moved to and from the tool of the press. At least a pair of releasable gripping means (preferably gripping pliers), are guided by the slide along a second axis which is adjustable relative to the first axis. A serving slide is adjustable along the first axis and the serving slide includes releasable gripping means (preferably gripping pliers) to advance a plate into a transfer position to be taken by the first gripping means. The first gripping means 26, 28 engage opposite sides of a plate 40, 40*a* at a trailing edge thereof. The transfer position corresponds to the plate position for the first cut and the transfer of the plate 40*a* to the first gripping means 26, 28 is performed during the first cut. The serving slide 30 brings the plate 40*a* into the transfer position only after the first gripping means 26, 28 have reached their receiving position along both axes 20, 21.

According to the present invention, the plate is engaged on opposite sides at the trailing edge. Thus, the movement of the gripping means beyond the plate edge and the further displacement in the opposite direction toward the edge are eliminated. The transfer position of the plate is no longer defined with the leading edge directly in front of the tool, but rather in the region of the tool. This means that the serving slide brings the plate only into the transfer position when the gripping means have reached the receiving position along both axes. The transfer of the plate to the transfer position in the first gripping means can be performed during the first cut while the plate is being held in fixed position by the cutting tool.

After the working of the preceding plate has been terminated, both axes of the feeding means, i.e. the gripping means and the feeding slide, return into the starting position in which the new plate is received. The path through which the gripping means are moved is substantially shorter than the path of the feeding slide along the longitudinal axis. As soon as the gripping means have reached the plate receiving position in the transverse axis or are located outside the feeding path of the new plate, the new plate may be advanced by the serving slide toward the tool. This is accomplished at the same time as the gripping means return along the longitudinal axis. When the gripping means are located outside the edges of the plate during its return, it is necessary that they be advanced along the second axis toward the plate as soon as they have reached their receiving position along the first axis. This is the case for plates having no straight side edges. For plates having straight side edges it is an advantage, according to an embodiment of the invention, for the gripping means to be moved along the second axis into the receiving position during or directly after the last cut of the tools after being released by the gripping means, and while the serving slide subsequently advances the plate through the open gripping means which are moved back along the first axis toward the transfer position.

Thus, the plate is advanced through the open gripping pliers while these are simultaneously moved back into the receiving position.

The steps just described reduce the nonproductive time to about a third compared to the hitherto-known systems, i.e. only two idle strokes are required at 200 strokes per minute. This increases the overall efficiency of a press about 12 to 17%, depending on the plate size. The necessary expenditure with respect to the structural design is not higher than with known systems; however, the serving slide has to be controlled more precisely in synchrony with the adjusting motions of the feeding system and the duty cycle of the press. Normally the advance is controlled numerically. The software for the numerical control thus has to be supplemented by the control of the serving slide. No other expenditure is required.

DETAILED DESCRIPTION OF THE INVENTION

Figure 1:
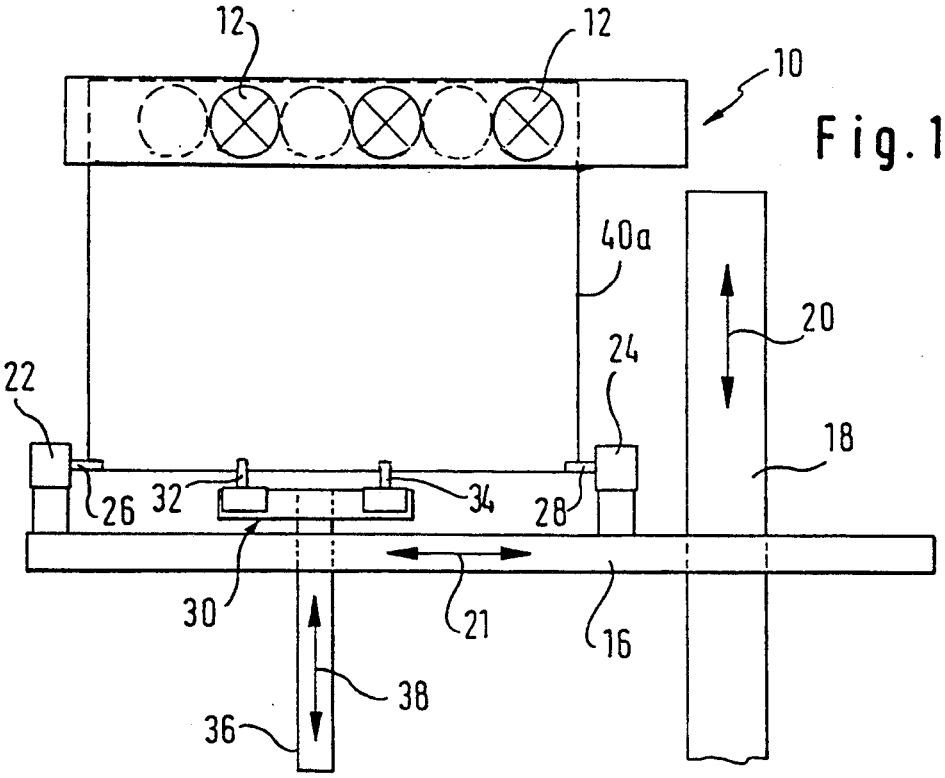
FIG. 1 shows a plane view of a schematically-illustrated plate positioning system according to the present invention during the transfer from a serving slide to a feeding means.
Figure 2:
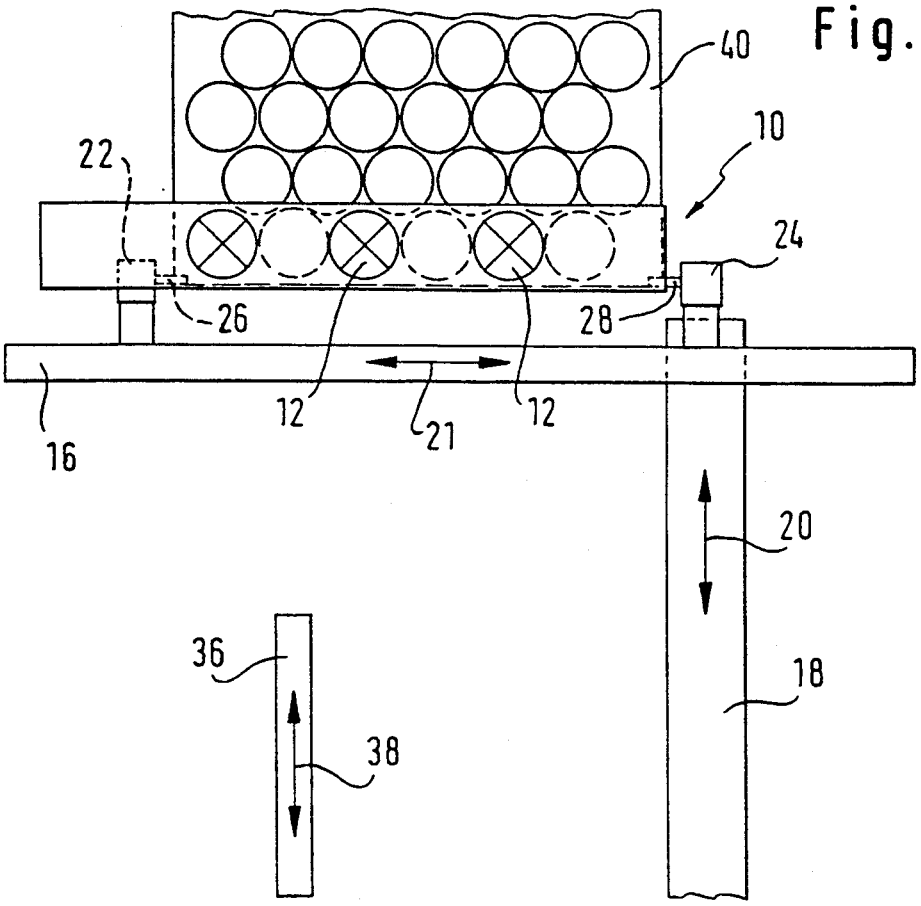
FIG. 2 shows an illustration similar to FIG. 1 wherein the working of a plate is completed.
Figure 3:
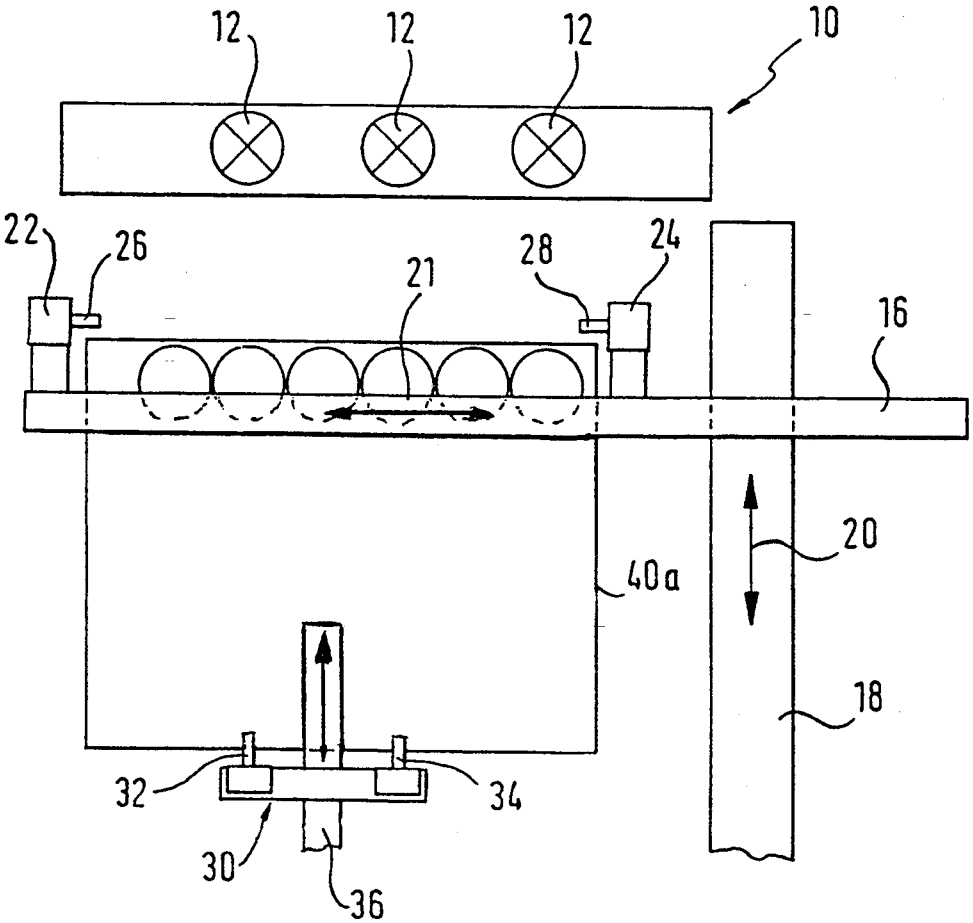
FIG. 3 shows an illustration similar to FIGS. 1 and 2 during the feeding of a plate by the serving slide, wherein the feeding means adjusts the plate into the transfer position of FIG. 1.

FIGS. 1 to 3 show press 10 of conventional design. Press 10 includes three tools 12 (for example, cutting tools) which are located at a tooling position which is a predetermined location at which the tools are operated. The tools are moved by a plunger vertically with respect to the plane of the drawing. Feeding slide 16 is moved along fixed guide 18 in the direction of double arrow 20. Feeding slide 16 includes holders 22, 24 for gripping pliers 26, 28. Feeding slide 16, holders 22, 24 and pliers 26, 28 are actuated by appropriate adjusting means which are controlled by an appropriate controller.

Serving slide 30 including a pair of gripping pliers 32, 34 is movable along fixed guiding slide 36 in the direction of double arrow 38. The drive means for serving slide 30 is not shown.

Gripping pliers 26, 28 and 32, 34 are conventional (for example, including a fixed jaw and a movable jaw), wherein the movable jaw is actuated by a suitable drive.

FIG. 2 shows plate 40 to be worked in the position in which the last cutting step is executed. As soon as cutting tools 12 engage plate 40, gripping pliers 26, 28 open and the feeding slide 16 returns gripping pliers 26, 28 into a transfer position as shown in FIG. 1. During this time, gripping pliers 32, 34 have engaged new plate **40*a*. When gripping pliers 26, 28 have reached their position along transverse axis 21, the receiving position is maintained at this axis. This is based on the fact that pliers 26, 28 engage the trailing edge of the plates at the side edges at opposite sides. While serving slide 30 thus advances new plate 40*a* along length axis 20 toward press 10, pliers 26, 28 move rearwardly due to the returning motion of feeding slide 16, wherein plate 40*a* is advanced through open pliers 26, 28, i.e. through the open mouth of pliers 26, 28. The advance of plate 40*a* is performed toward press 10 according to FIG. 1, wherein the transfer position corresponds to a position in which tools 12 may perform the first cut. Since press 10 is continuously running during the steps described, care must be taken that serving slide 30 moving plate 40*a* only moves into press 10 when the gripping pliers have reached the receiving position shown in FIG. 1. At the moment in which tools 12 cut plate 40*a* and thus fix the position of plate 40*a*, gripping pliers 32, 34 are opened and pliers 26, 28 are closed, so that the transfer from serving slide 30 to feeding slide 16** takes place.

Since gripping pliers 26, 28 have to be moved in one direction only, i.e. along axis 20, a minimum time results from the transfer operation of plates from serving slide 30 to feeding slide 16, which time corresponds to two idle strokes of press 10. This transfer time is thus substantially shorter than with conventional feeding systems.

That which is claimed is:

1. A system for feeding plates having leading and trailing edges through a press having a tooling position, including:

a plate feeding slide;

first releasable plate gripping means mounted to the plate feeding slide;

first feeding slide guide means for guiding the plate feeding slide and first releasable plate gripping means parallel to a first axis through reciprocal plate feeding strokes toward the tooling position and return strokes away from the tooling position, such that the plate feeding slide reciprocates between a transfer position and a release position, wherein the transfer position is a position on the first axis at which the first gripping means is spaced from the tooling position of the press and grips the plate such that the leading edge of the plate is positioned at the tooling position of the press, the release position is a position on the first axis at which the plate feeding slide is at a position spaced from the transfer position in a direction toward the tooling position such that the trailing edge of the plate is positioned at the tooling position of the press, wherein the first gripping means grips the plate when the plate is positioned at the transfer position for a first tooling operation by the press, and releases the plate after a last tooling operation when the plate is at the release position;

second feeding slide guide means on the plate feeding slide for guiding the plate gripping means along a second axis, wherein said second axis is generally transverse to the first axis in both said transfer and release positions;

a plate serving slide including second releasable plate gripping means; and serving slide guide means for guiding the serving slide parallel to the first axis through reciprocal plate transfer strokes toward the transfer position and return strokes away from the transfer position, such that the serving slide reciprocates between a plate engaging position and the transfer position, wherein the plate engaging position is a position along the first axis at which the serving slide is spaced from the transfer position in a direction away from the tooling position and the leading edge of the plate is spaced from the transfer position, and the second releasable plate gripping means grips the plate when the serving slide is positioned at the plate engaging position, and releases the plate when the serving slide is at the transfer position.

2. The plate feeding system of claim 1 wherein the first gripping means includes means for gripping opposite sides of the plate at the trailing edge, and the first gripping means grips the plate when the plate is at the transfer position and firmly engaged by the press for a first tooling operation.

3. The plate feeding system of claim 2 wherein the serving slide guide means further guides the serving slide through the transfer stroke to the transfer position after the first gripping means has reached the transfer position along the first axis and a plate receiving position along the second axis.

4. The plate feeding system of claim 3 wherein the first feeding slide guide means further guides the plate feeding slide parallel to the first axis into said transfer position when the plate is firmly engaged by the press for a final tooling operation and the first gripping means has opened, and while the serving slide advances into the transfer position and carries a next plate through the open first gripping means, which has retracted from the press through said return stroke along the first axis.

* * * * *